US007723003B2

(12) United States Patent
Tanaka et al.

(10) Patent No.: US 7,723,003 B2
(45) Date of Patent: May 25, 2010

(54) TONER FOR DEVELOPING ELECTROSTATIC LATENT IMAGE, DEVELOPER FOR DEVELOPING ELECTROSTATIC LATENT IMAGE, AND IMAGE-FORMING PROCESS USING THE TONER FOR DEVELOPING ELECTROSTATIC LATENT IMAGE

(75) Inventors: Tomoaki Tanaka, Kanagawa (JP); Seijirou Ishimaru, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 606 days.

(21) Appl. No.: 11/440,074

(22) Filed: May 25, 2006

(65) Prior Publication Data

US 2007/0141497 A1 Jun. 21, 2007

(30) Foreign Application Priority Data

Dec. 16, 2005 (JP) ..... 2005-363574

(51) Int. Cl.
*G03G 9/087* (2006.01)

(52) U.S. Cl. ..... 430/108.8; 430/108.1; 430/109.1; 430/109.4

(58) Field of Classification Search ..... 430/108.1, 430/108.8, 109.1, 109.4
See application file for complete search history.

(56) References Cited

U.S. PATENT DOCUMENTS

| | | | | |
|---|---|---|---|---|
| 6,174,639 | B1 * | 1/2001 | Shimizu et al. | 430/108.22 |
| 6,203,959 | B1 * | 3/2001 | Tanikawa et al. | 430/108.8 |
| 2002/0045120 | A1 * | 4/2002 | Yoshikawa et al. | 430/108.5 |
| 2003/0049553 | A1 * | 3/2003 | Nakamura et al. | 430/108.21 |
| 2003/0147670 | A1 * | 8/2003 | Asano et al. | 399/223 |

FOREIGN PATENT DOCUMENTS

| | | |
|---|---|---|
| JP | A 07-219381 | 8/1995 |
| JP | A 2000-250368 | 9/2000 |
| JP | A 2001-117271 | 4/2001 |

* cited by examiner

*Primary Examiner*—Mark F Huff
*Assistant Examiner*—Peter L Vajda
(74) *Attorney, Agent, or Firm*—Oliff & Berridge, PLC

(57) ABSTRACT

The present invention provides a toner for developing an electrostatic latent image comprising a releasing agent containing a hydrocarbon, a binder resin, and a colorant, wherein, when an average carbon number of the hydrocarbon is designated as N, the hydrocarbon contains components having a carbon number in the range of (N−10) to (N+10) in an amount of 70% by mass or more in the entire hydrocarbon and has a weight-average molecular weight of 12,000 or more and 25,000 or less, a developer for developing an electrostatic latent image containing the toner for developing an electrostatic latent image, and an image-forming process using the toner for developing an electrostatic latent image.

15 Claims, No Drawings

TONER FOR DEVELOPING ELECTROSTATIC LATENT IMAGE, DEVELOPER FOR DEVELOPING ELECTROSTATIC LATENT IMAGE, AND IMAGE-FORMING PROCESS USING THE TONER FOR DEVELOPING ELECTROSTATIC LATENT IMAGE

CROSS-REFERENCE TO RELATED APPLICATION

This application claims priority under 35 USC 119 from Japanese Patent Application No. 2005-363574, the disclosure of which is incorporated by reference herein.

BACKGROUND

1. Technical Field

The present invention relates to a toner for developing an electrostatic latent image, a developer for developing an electrostatic latent image and an image-forming process for use in electrophotography copying machines, electrophotography facsimiles, electrophotography printers, and the like.

2. Related Art

Generally, electrophotographic processes include (1) a step of charging a photoreceptor, (2) a step of forming a latent image on the photoreceptor by exposure thereof to light, (3) a step of developing the latent image with a developer including a toner, (4) a step of transferring the developed toner onto a medium such as paper, and (5) a step of fixing the toner image transferred onto the medium. Among the above steps, a heat roll method of heating the toner directly with a heated roller, and a flash-fixing method of fixing the toner by heat generated by irradiation of a flash light, such as that from a xenon, halogen, or other lamp, are well known as the fixing step.

An advantage of the heat roll method is that it is possible to easily make the surface of a fixed toner image smooth and uniform to a certain extent, even when a material that changes its viscosity by heating and shows an elastic repulsion under applied pressure, such as a binder resin contained in toner, is used, because the toner is fixed on paper as it is heated directly at high temperature under pressure by a heating roll. However, use of this method often results in fluctuation in image characteristics such as glossiness, because the heating roll is often cooled by paper while the paper is conveyed in the fixing device and thus, the fixing temperature often declines when a number of sheets of paper are printed continuously at high speed. It is necessary to raise the temperature setting of a heating roller to overcome this disadvantage, occasionally leading to a heating-roller surface temperature of 250° C. or higher, deterioration of the surface of the heating roller, and consequently to deterioration in releasing characteristics.

In contrast, the flash-fixing method has the following advantages:

1) there is no staining of images due to offsetting of the residual toner that is generated when heating rollers are used, because it is a non-contact fixing process;

2) it does not demand a design for preventing the image staining often found during contact fixing (addition of a releasing agent to toner, or coating of a fixing roller with a releasing agent such as silicon oil), and thus, there is a greater freedom in designing the toner and the fixing unit; and 3) it is possible to fix the images irrespective of the material and the thickness of the recording paper.

For these reasons, the flash-fixing method may be used in high-speed applications such as high-speed printers and high-speed copying machines. However, the flash-fixing method raises the surface temperature of toner instantaneously to 300° C. or higher.

Components contained in a toner sublime at such a high temperature, occasionally resulting in internal contamination of a device.

Thus, it is necessary to adopt measures to prevent such troubles, such as a method of reducing the amount of the sublimates by controlling the amount of low-molecular weight components in the binder resin, which is a component of the toner (e.g., Japanese Patent Application Laid-Open (JP-A) No. 2001-117271), or a method of installing a dust-collecting mechanism such as an exhaust gas filter (e.g., JP-A Nos. 7-219381 and 2000-250368). However, among the sublimates, more polar binder resin-derived components decompose and sublime during flash fixation at high temperature, but other less-polar materials remain un-decomposed and low polarity sublimates cool rapidly and deposit on the exhaust gas filter or other members. As a result, low polarity sublimates cool and harden at the upper layer of the filter and are thus deposited on the surface of each member and when, for example, an exhaust gas filter is used, this leads to clogging of the filter, causing problems such as inefficient use of the filter surface and shortening of the lifetime of the filter.

SUMMARY

The present invention has been made in view of the above circumstances and provides a toner for developing an electrostatic latent image, a developer for developing the electrostatic latent image, and an image-forming process using the toner for developing the electrostatic latent image.

According to an aspect of the invention, a toner for developing an electrostatic latent image comprises a releasing agent containing a hydrocarbon, a binder resin, and a colorant, wherein, when an average carbon number of the hydrocarbon is designated as N, the hydrocarbon contains components having a carbon number in the range of (N−10) to (N+10) in an amount of 70% by mass or more in the entire hydrocarbon and has a weight-average molecular weight of from approximately 12,000 to approximately 25,000.

According to another aspect of the invention, a developer for developing an electrostatic latent image comprises a toner and a carrier, wherein the toner is the toner for developing an electrostatic latent image toner described in the aspect above.

According to another aspect of the invention, an image-forming process comprises charging a photoreceptor, forming a latent image on the photoreceptor by exposing the charged photoreceptor to light, forming a toner image by developing the latent image formed on the photoreceptor with a developer containing a toner, transferring the toner image formed on the photoreceptor onto an image-receiving member, and fixing the toner image transferred onto the image-receiving member, wherein the toner is the toner for developing an electrostatic latent image described in the aspect above.

BRIEF DESCRIPTION

The toner for developing an electrostatic latent image according to the invention (hereinafter, referred to as "the toner according to the invention") is a toner for developing an electrostatic latent image comprising a releasing agent containing a hydrocarbon, a binder resin, and a colorant, wherein, when an average carbon number of the hydrocarbon is designated as N, the hydrocarbon contains components having a carbon number in the range of (N−10) to (N+10) in an amount of 70% by mass or more in the entire hydrocarbon and has a weight-average molecular weight of 12,000 or more and 25,000 or less.

By analyzing sublimates contained in the toner for developing an electrostatic latent image, the present inventors have found that most of the low-polar sublimates are the components in the releasing agent. Common releasing agents used for toner for developing an electrostatic latent image are natural waxes, such as vegetable, animal and mineral waxes, and synthetic waxes; and the molecular weight thereof is usually several hundreds to several thousands. Components lower in molecular weight in such a releasing agent often sublimate and deposit by cooling, under the condition of heating instantaneously to 300° C. or higher. In contrast, in high polar resins such as binder resin, only components extremely lower in molecular weight sublimate. Such components precipitate in a smaller amount by cooling, and thus, are less adhesive to filter.

Among these releasing agents, synthetic waxes allow an increase of the molecular weight. There are methods of cleaving the molecular chain of a high-molecular weight resin and of preparing a high-molecular weight releasing agent in direct polymerization of a polymerizable monomer; but the releasing agents prepared by these production methods have a wider molecular-weight distribution as the molecular weight increases; and thus, it is not possible to control the sublimates.

The invention provides a toner that generates a smaller amount of sublimates even when heated instantaneously to high temperature and thus prevents adhesion thereof to exhaust gas filter and other members, that is prepared by using a releasing agent containing a hydrocarbon, wherein, when the average carbon number of the hydrocarbon is designated as N, the hydrocarbon contains the components having the carbon number in the range of (N−10) to (N+10) in an amount of 70% by mass or more in the entire hydrocarbon and has a weight-average molecular weight of 12,000 or more and 25,000 or less (hereinafter, referred to as the "hydrocarbon according to the invention").

The weight-average molecular weight of the hydrocarbon according to the invention is determined under the following condition: GPC apparatus: "HLC-8120GPC, SC-8020 (manufactured by Tosoh Corporation)"; columns: two columns, TSK gel and Super HM-H (manufactured by Tosoh Corporation, 6.0 mmID×15 cm)"; and eluant:toluene. As for the measuring conditions, the sample concentration was 0.5%: the flow rate, 0.6 ml/min; the sample injection, 10 μl; the measurement temperature, 60° C.; and the detector, an IR detector. A calibration curve is prepared by using 10 polystyrene standard samples: "TSK Standards" manufactured by Tosoh Corp.: "A-500", "F-1", "F-10", "F-80", "F-380", "A-2500", "F-4", "F-40" "F-128", and "F-700".

The ratio of the components having the carbon number in the range of (N−10) to (N+10) in all hydrocarbons can be determined by the following method: First, a calibration curve between the weight-average molecular weight and the period from sample injection to peak appearance is drawn by using each of the standard samples described above. The weight-average molecular weight (Mw) of a hydrocarbon is determined, and a value (Mw/14) obtained by dividing the Mw by 14 ($CH_2$) is the number of carbons N. Although the terminal of the hydrocarbon is $CH_3$ more accurately, the number is in a fudge factor, and thus, the value obtained by dividing by 14 may be regarded as the number of carbons.

N−10 is (Mw/14)−10; and the weight-average molecular weight at N−10 is {(Mw/14)−10}×14=Mw−140, while the weight-average molecular weight at N+10 is Mw+140.

When the retention times corresponding to Mw−140 and Mw+140, as determined from the calibration curve described above, are designated temporarily, respectively as t(Mw−140) and t(Mw+140), the ratio above is a percentage ratio of the amount of the components detected during the period of t(Mw+140) to t(Mw−140) with respect to the amount of the entire sample. Normally, the GPC measurement result is a plot of detection amount vs. retention time, and thus, the ratio is obtained by determining the percentage of the area detected during the period of t(Mw+140) to t(Mw−140) in the entire detected entire area.

The content of the hydrocarbon according to the invention in the releasing agent is preferably 85% by mass or more, more preferable 90% by mass or more, and still more preferably 95% by mass or more. When the ratio of the hydrocarbon according to the invention in the releasing agent is less than 85% by mass, the releasing agent occasionally releases a small amount of sublimates when heated instantaneously to high temperature.

It is possible to prepare the hydrocarbon according to the invention without decrease in the properties, specifically in the releasing characteristics, as a releasing agent, by fractionating a releasing agent of commercially available hydrocarbon having a weight-average molecular weight of approximately 12,000 or more and 25,000 or less, while removing its high-polymer and low-molecular components. It is possible to obtain the releasing agent by determining the retention period for the components having a desirable weight-average molecular weight and fractionating the components during the retention period, for example, by means of preparative HPLC.

Specifically, (1) A calibration curve is drawn by determining the retention time of the absorption peak of each polystyrene having a known molecular weight by using polystyrene standard samples dissolved in toluene and a preparative HPLC apparatus (LC-9101: manufactured by Japan Analytical Industry Co. Ltd.).

(2) Then, the peak molecular weight of a releasing agent sample is then determined and the number of carbons thereof from the molecular weight. For example, when polyethylene is used as the sample and the determined weight-average molecular weight is 14,000, the number of carbons is 1,000, because the molecular weight of the structural unit of polyethylene $CH_2$ is 14.

(3) The weight-average molecular weights corresponding to N−10 and N+10 are then determined from the peak molecular weight, and the retention times for the components having the weight-average molecular weights corresponding to N−10 and N+10 are determined from the calibration curve described above.

(4) The releasing agent components during the period are then fractionated.

The fractionation of the releasing agent components in (4) is repeated, until the amount of the components eluting during the period of N−10 to N+10 exceeds 70% by mass or more with respect to the entire releasing agent.

If the weight-average molecular weight of the hydrocarbon according to the invention is 12,000 or more and 25,000 or less, it is possible to prepare a releasing agent desirable for the invention that has the releasing characteristics needed for releasing agent and still does not release sublimates. The weight-average molecular weight is preferably 12,000 or more and 20,000 or less; and the more preferable weight-average molecular weight is 13,000 or more and 18,000 or less. A hydrocarbon according to the invention having a weight-average molecular weight of less than 12,000 may lead to difficulty in removing the sublimates, while a hydrocarbon having a molecular weight of more than 25,000 may lead to deterioration in releasing characteristics because of difficulty in fusion of the releasing agent during fixing.

The average carbon number N of the hydrocarbon according to the invention is preferably 850 to 1,790 and more preferably 900 to 1,500.

On the other hand, the ratio of the components having a carbon number in the range of (N−10) to (N+10) in the hydrocarbon according to the invention should be 70% by mass or more, preferably 75% by mass or more, and more preferable 80% by mass or more.

The hydrocarbon according to the invention is preferably a less polar hydrocarbon. Specifically, a hydrocarbon having an acid value closer to 0 mgKOH/g is preferable. Hydrocarbons having an acid value of 1 mgKOH/g or less can be used favorably. A more polar releasing agent has increased compatibility with the binder resin, resulting in deterioration in the releasing characteristics during fixing.

Examples of the hydrocarbons according to the invention include olefin waxes such as polyethylene wax and polypropylene wax, paraffin waxes, and the like; and Fischer-Tropsch waxes, microcrystalline waxes, and the like may be used. Hydrocarbons containing unsaturated bonds in its structure may be used, but, because the unsaturated bonds are often oxidized, for example, by oxygen in air into polar functional groups such as alcohol and ketone, saturated hydrocarbon waxes are preferable. The hydrocarbon according to the invention is more preferably a polyethylene or polypropylene wax.

The components contained in the releasing agent other than the hydrocarbon according to the invention are not particularly limited, if they are known releasing agent components; and examples thereof include, but are not limited to, natural waxes such as carnauba wax, rice wax, and candelilla wax; synthetic or mineral-petroleum waxes such as low-molecular weight polypropylene, low-molecular weight polyethylene, sazol wax, microcrystalline wax, Fischer-Tropsch wax, paraffin wax, and montan wax; ester waxes such as fatty acid esters and montanic acid esters; and the like. These releasing agents may be used alone or in combination of two or more.

The melting point of the component in releasing agent other than the hydrocarbon according to the invention is preferably 50° C. or higher, more preferable 60° C. or higher, from the viewpoint of storage life. In addition, it is preferably 110° C. or lower and more preferably 100° C. or lower from the viewpoint of offset resistance.

The content of the releasing agent in the toner according to the invention is preferably 1 to 20% by mass with respect to the total mass of the toner, for preservation of sufficiently favorable releasing characteristics. The content is more preferably 3 to 15% by mass and still more preferably 4 to 12% by mass.

<Binder Resin>

The binder resin for use in the electrophotographic toner according to the invention is preferably polyester from the viewpoint of electrostatic properties. Favorable materials other than polyester include ethylene resins such as polyethylene and polypropylene; styrene resins containing polystyrene, poly(α-methylstyrene), or the like as the principal component; (meth)acrylic resins containing polymethyl methacrylate, polyacrylonitrile, or the like as the principal component; polyamide resins, polycarbonate resins, polyether resins, and the copolymer resins thereof.

Examples of the condensation monomers for the polyester resins include the condensation monomer components described, for example, in "Polymer Data Handbook: Basic Edition" (Soc. Polymer Science, Japan Ed.: Baihukan), which include known bivalent, trivalent or higher carboxylic acids and bivalent, trivalent or higher alcohols. Typical examples of the bivalent carboxylic acids include dibasic acids such as succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid, and mesaconic acid, the anhydrides thereof, and the lower alkyl esters thereof; aliphatic unsaturated dicarboxylic acids such as maleic acid, fumaric acid, itaconic acid, and citraconic acid; and the like. Examples of the trivalent or higher carboxylic acids include 1,2,4-benzenetricarboxylic acid, 1,2,5-benzenetricarboxylic acid, 1,2,4-naphthalenetricarboxylic acid, and the anhydride and the lower alkyl esters thereof, and the like. These acids may be used alone or in combination of two or more.

Examples of the bivalent alcohols include bisphenol A, hydrogenated bisphenol A's, bisphenol A ethyleneoxide or (and) propyleneoxide adducts, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, 1,9-nonanediol, neopentylglycol, and the like. Examples of the trivalent or higher alcohols include glycerol, trimethylolethane, trimethylolpropane, pentaerythritol, and the like. These alcohols may be used alone or in combination of two or more. It is also possible to use a monovalent acid such as acetic acid or benzoic acid, or a monovalent alcohol such as cyclohexanol or benzyl alcohol additionally, as needed, for adjustment of the acid or hydroxyl value.

The polyester resin can be prepared from any combination of the condensation monomer components above by the known methods described, for example, in "Polycondensation" (Kagaku-dojin Publishing Company, 1971), "Experiments in Polymer Science (polycondensation and polyaddition)" (Kyoritsu Shuppan Co., Ltd., 1958), "Polyester Resin Handbook" (Nikkankogyo Shimbun Ed., 1988) and others; and can be prepared by ester exchange method, direct polycondensation method, and the like, alone or in combination.

Although it is desirable to leave carboxyl groups in the molecule skeleton of the resin, it is difficult to introduce a carboxyl group on the side chain of the molecule by the production method for polyester resins, and thus, it is possible to raise the heat resistance and the charging stability to some degree by leaving carboxyl groups at both terminals of the resin molecule. Accordingly, the acid value of the resin is preferable higher, and, specifically, preferably in the range of 5 to 50 mgKOH/g, and more preferably 10 to 40 mgKOH/g.

Styrene resins and (meth)acrylic resins, in particular styrene-(meth)acrylic copolymer resins, are favorably used as the binder resins according to the invention.

A latex of a copolymer obtained by polymerization of a monomer mixture of 60 to 90 parts by mass of a vinyl aromatic monomer (styrene-based monomer), 10 to 40 parts by mass of an ethylenic unsaturated carboxylic ester monomer ((meth)acrylic ester-based monomer), and 1 to 3 parts by mass of an ethylenic unsaturated acid monomer dissolved with a surfactant can be used favorably as the binder resin component. In the present specification, the term "(meth) acrylic" means "acrylic" and "methacrylic".

The glass transition temperature of the copolymer is preferably 50 to 70° C.

Hereinafter, the polymerizable monomers for the copolymer resin will be described. Examples of the styrene-based monomers include styrene, alkyl-substituted styrenes having an alkyl chain such as α-methylstyrene, vinylnaphthalene, 2-methylstyrene, 3-methylstyrene, 4-methylstyrene, 2-ethylstyrene, 3-ethylstyrene, and 4-ethylstyrene; halogen-substituted styrenes such as 2-chlorostyrene, 3-chlorostyrene, and 4-chlorostyrene; fluorine-substituted styrenes such as 4-fluorostyrene and 2,5-difluorostyrene; and the like. The styrene-based monomer is preferably styrene.

Examples of the (meth)acrylic ester-based monomers include methyl (meth)acrylate, ethyl(meth)acrylate, n-propyl (meth)acrylate, n-butyl(meth)acrylate, n-pentyl(meth)acrylate, n-hexyl(meth)acrylate, n-heptyl(meth)acrylate, n-octyl (meth)acrylate, n-decyl(meth)acrylate, n-dodecyl(meth) acrylate, n-lauryl (meth)acrylate, n-tetradecyl(meth)acrylate, n-hexadecyl(meth)acrylate, n-octadecyl (meth)acrylate, isopropyl(meth)acrylate, isobutyl(meth)acrylate, t-butyl(meth) acrylate, isopentyl(meth)acrylate, amyl(meth)acrylate, neopentyl(meth)acrylate, isohexyl (meth)acrylate, isoheptyl (meth)acrylate, isooctyl(meth)acrylate, 2-ethylhexyl (meth) acrylate, phenyl(meth)acrylate, biphenyl(meth)acrylate, diphenylethyl (meth)acrylate, t-butylphenyl(meth)acrylate, terphenyl(meth)acrylate, cyclohexyl (meth)acrylate, t-butylcyclohexyl(meth)acrylate, diethylaminoethyl(meth)acrylate, diethylaminoethyl(meth)acrylate, methoxyethyl(meth)acrylate, 2-hydroxyethyl (meth)acrylate, β-carboxyethyl(meth) acrylate, (meta)acrylonitrile, (meta)acrylamide, and the like. The (meth)acrylic ester-based monomer is preferably n-butyl acrylate.

The ethylenic unsaturated acid monomer is an ethylenic unsaturated monomer containing an acidic group such as carboxyl group, sulfonic acid group, or acid anhydride group.

It is possible to prepare the styrene resin, (meth)acrylic resin, and styrene-(meth)acrylic copolymer containing carboxyl groups, by copolymerization with a carboxyl group-containing polymerizable monomer.

Typical examples of the carboxyl group-containing polymerizable monomers include acrylic acid, aconitic acid, atropic acid, allylmalonic acid, angelic acid, isocrotonic acid, itaconic acid, 10-undecenoic acid, elaidic acid, erucic acid, oleic acid, ortho-carboxycinnamic acid, crotonic acid, chloroacrylic acid, chloroisocrotonic acid, chlorocrotonic acid, chlorofumaric acid, chloromaleic acid, cinnamic acid, cylcohexenedicarboxylic acid, citraconic acid, hydroxycinnamic acid, dihydroxycinnamic acid, tiglic acid, nitrocinnamic acid, vinylacetic acid, phenylcinnamic acid, 4-phenyl-3-butenoic acid, ferulic acid, fumaric acid, brassidic acid, 2-(2-furyl) acrylic acid, bromocinnamic acid, bromofumaric acid, bromomaleic acid, benzylidenemalonic acid, benzoylacrylic acid, 4-pentenoic acid, maleic acid, mesaconic acid, methacrylic acid, methylcinnamic acid, methoxycinnamic acid, and the like; and acrylic acid, methacrylic acid, maleic acid, cinnamic acid, fumaric acid, and the like are preferable; and acrylic acid is most preferable, from the point of the efficiency of polymer-forming reaction.

A chain-transfer agent may be used during polymerization of the binder resin for use in the toner according to the invention. The chain-transfer agent is not particularly limited, and thiol component-containing compounds may be used. Specifically, alkyl mercaptans such as hexylmercaptan, heptylmercaptan, octylmercaptan, nonylmercaptan, decylmercaptan, and dodecylmercaptan are preferable, because they make a binder resin narrower in molecular weight distribution and thus, superior in the storage life of the resulting toner at high temperature.

The binder resin according to the invention may contain as needed a crosslinking agent. The crosslinking agent is typically a multifunctional monomer containing two or more ethylenic polymerizable unsaturated groups in the molecule.

Typical examples of such crosslinking agents include aromatic polyvinyl compounds such as divinylbenzene and divinylnaphthalene; aromatic polyvalent carboxylic acid polyvinyl esters such as divinyl phthalate, divinyl isophthalate, divinyl terephthalate, divinyl homophthalate, divinyl/trivinyl trimesates, divinyl naphthalenedicarboxlate, and divinyl biphenylcarboxylate; nitrogen-containing aromatic compound divinyl esters such as divinyl pyridinedicarboxylate; unsaturated heterocyclic compound carboxylic acid vinyl esters such as vinyl furancarboxylate, vinyl pyrrole-2-carboxylate, and vinyl thiophenecarboxylate; straight-chain polyvalent alcohol (meth)acrylic esters such as butanediol methacrylate, hexanediol acrylate, octanediol methacrylate, decanediol acrylate, and dodecanediol methacrylate; branched-chain substituted polyvalent alcohol (meth)acrylic esters such as neopentylglycol dimethacrylate and 2-hydroxy-1,3-diacryloxypropane; polyethylene glycol di(meth) acrylates and polypropylene polyethylene glycol di(meth) acrylates; polyvalent carboxylic acid polyvinyl esters such as divinyl succinate, divinyl fumarate, vinyl/divinyl maleates, divinyl diglycolate, vinyl/divinyl itaconates, divinyl acetonedicarboxylate, divinyl glutarate, 3,3'-divinyl-thiodipropionate, divinyl/trivinyl trans-aconitates, divinyl adipate, divinyl pimelate, divinyl suberate, divinyl azelaate, divinyl sebacate, divinyl dodecanedicarboxylate, and divinyl brassylate; and the like.

In the invention, these crosslinking agents may be used alone or in combination of two or more. Among the crosslinking agent above, crosslinking agents favorably used in the invention include straight-chain polyvalent alcohol (meth) acrylic esters such as butanediol methacrylate, hexanediol acrylate, octanediol methacrylate, decanediol acrylate, and dodecanediol methacrylate; branched-chain substituted polyvalent alcohol (meth)acrylic esters such as neopentylglycol dimethacrylate and 2-hydroxy-1,3-diacryloxy propane; polyethylene glycol di(meth)acrylates and polypropylene polyethylene glycol di(meth)acrylates; and the like.

The content of the crosslinking agent is preferably in the range of 0.05 to 5% by mass, more preferably in the range of 0.1 to 1.0% by mass, in the total amount of the polymerizable monomers.

Among the binder resins for use in the toner according to the invention, those that can be prepared by radical polymerization of monomers are prepared by using a radical polymerization initiator.

The radical polymerization initiator for use is not particularly limited. Typical examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butyl triphenylperacetate hydroperoxide, tert-butyl performate, tert-butyl peracetate, tert-butyl perbenzoate, tert-butyl perphenylacetate, tert-butyl permethoxyacetate, and N-tert-butyl (3-toluyl) percarbamate; azo compounds such as 2,2'-azobispropane, 2,2'-dichloro-2,2'-azobispropane, 1,1'-azo(methylethyl)diacetate, 2,2'-azobis(2-amidino propane) hydrochloride salt, 2,2'-azobis(2-amidinopropane) nitrate salt, 2,2'-azobisisobutane, 2,2'-azobisisobutylamide, 2,2'-azobisisobutylonitrile, methyl 2,2'-azobis-2-methylpropionate, 2,2'-dichloro-2,2'-azobisbutane, 2,2'-azobis-2-methylbutylonitrile, dimethyl 2,2'-azobisisobutyrate, 1,1'-azobis(1-methylbutylonitrile-3-sulfonic acid sodium salt), 2-(4-methylphenylazo)-2-methyl malonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovaleric acid, 2,2'-azobis-2,4-dimethylvaleronitrile, 1,1'-azobiscyclohexanenitrile, 2,2'-azobis-2-propylbutylonitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly (bisphenol A-4,4'-azobis-4-cyanopentanate), and poly (tetraethyleneglycol-2,2'-azobisisobutyrate); 1,4-bis (pentaethylene)-2-tetrazen, 1,4-dimethoxycarbonyl-1,4-diphenyl-2-tetrazen, and the like.

The ratio (weight-average molecular weight)/(number-average molecular weight) of the binder resin is preferably 2.0 to 5.0, more preferably 2.0 to 4.0, and still more preferably 2.0 to 3.5. A ratio (weight-average molecular weight)/(number-average molecular weight) of the binder resin of less than 2.0 may cause a trouble of prevention of rapid solubilization due to interaction between releasing agents, while a ratio of more than 5.0 may not allow prevention of release of less-polar sublimates.

(Colorant)

The colorant for use in the toner according to the invention is not particularly limited, if it is a known colorant, and examples thereof include carbon blacks such as furnace black, channel black, acetylene black, and thermal black; inorganic pigments such as bengala, iron blue, and titanium oxide; azo pigments such as Fast Yellow, disazo yellow, pyrazolone red, chelate red, Brilliant Carmine, and Para Brown; phthalocyanine pigments such as copper phthalocyanine and nonmetal phthalocyanine; fused polycyclic pigments such as fravantrone yellow, dibromoanthrone orange, perylene red, quinacridone red, and dioxazine violet; other various pigments such as chromium yellow, Hanza Yellow, benzidine yellow, threne yellow, quinoline yellow, Permanent Orange GTR, pyrazolone orange, Vulcan Orange, Watchung Red, Permanent Red, DuPont oil red, Lithol Red, rhodamine B lake, lake red C, rose bengal, aniline blue, ultramarine blue, Calco Oil blue, methylene blue chloride, phthalocyanine blue, phthalocyanine green, malachite green oxalate, C.I. Pigment Red 48:1, C.I. Pigment Red 122, C.I. Pigment 57:1, C.I. Pigment Yellow 12, C.I. Pigment Yellow 97, C.I. Pigment Yellow 17, C.I. Pigment Yellow 180, C.I. Pigment Yellow 74, C.I. Pigment Blue 15:1, and C.I. Pigment Blue 15:3; and the like, and these colorants may be used alone or in combination of two or more.

An infrared absorbent is preferably added to the toner according to the invention for improvement in high infrared ray absorption capacity. The infrared absorbent is not particularly limited, and typical examples thereof include vanadylnaphthalocyanine, aminium, diimmonium, cyanine, nickel complexes, phthalocyanine and ytterbium oxide compounds, and the like.

The amount of the infrared absorbent added is preferably in the range of 0.01 to 10 parts by mass, more preferably in the range of 0.05 to 5 parts by mass, with respect to 100 parts by mass of the toner. An addition amount of less than 0.05 parts by mass may lead to decrease in the light-absorbing capacity of toner in the near-infrared region and defects in fixing. On the other hand, an addition amount of more than 10 parts by mass may lead to troubles, for example in charging, and to change in color tone, although the photofixing efficiency is favorable.

In addition, a lubricant and a charge control agent may be added as needed to the toner according to the invention.

Examples of the lubricants for use include fatty acid amides such as ethylene bisstearic amide and oleic amide; fatty acid metal salts such as zinc stearate and calcium stearate; and the like.

The charge control agent is added for more stabilization of the charging properties, and any one of various common charge control agents, such as quaternary ammonium salt compounds, nigrosine compounds, metal-complexed dyes complexed with aluminum, iron, chromium, or the like, and triphenylmethane pigments, may be used; but the charge control agent is preferably a material less soluble in water, for control of the ionic strength that governs the stability of the aggregate particles in the aggregation and coalescence steps during production of the toner, for example by the emulsification aggregation method described below, and for prevention of waste water pollution.

In particular, the charge control agent is preferably a compound selected from the group consisting of benzoic acid metal salts, salicylic acid metal salts, alkyl salicylic acid metal salts, catechol metal salts, metal-containing bisazo dyes, tetraphenyl borate derivatives, quaternary ammonium salts, and alkylpyridinium salts that are used in powdery toners, or a suitable combination thereof.

When inorganic particles are added to a toner in a wet process as the charge control agent, examples of such inorganic particles for use include all inorganic particles commonly used as the external additive onto toner surface such as particles of silica, alumina, titania, calcium carbonate, magnesium carbonate, and tricalcium phosphate. In such a case, the inorganic particles may be used as dispersed in a solvent, for example, by using an ionic surfactant or a polymer acid or base.

In addition, an inorganic or organic powder in dry state may be added onto the surface of the toner according to the invention under shearing force, for the purpose of using it as a flow-improving aid, a cleaning aid, or the like.

Examples of the inorganic powders include all powders commonly used as the external additive for toner surface such as of silica, alumina, titania, calcium carbonate, magnesium carbonate, tricalcium phosphate, and cerium oxide; and examples of the organic powders include all powders commonly used as the external additive for toner surface such as of vinyl resins, polyester resins, and silicone resins.

When the material is used as an external additive, the amount of all external additives added is preferably 2% by mass or more, more preferably 3% by mass or more, with respect to the entire toner. A content of less than 2% by mass may lead to insufficient separation of toner particles and prohibit sufficient exudation of the releasing agent. The upper limit of the total addition amount of the external additives is preferably 10% by mass or less, more preferably 8% by mass or less, with respect to the entire toner.

The volume-average diameter of the toner according to the invention is preferably in the range of 4 to 10 μm, more preferably in the range of 5 to 8 μm, and still more preferably in the range of 5.5 to 7.5 μm. A volume-average diameter of 4 μm or more is effective in preventing generation of the cloud caused by scattering of toner. On the other hand, it is possible to obtain favorable images at a diameter of 10 μm or less.

The water content of the toner is preferably 0.5% by mass or less with respect to the total mass of the toner, from the viewpoint of fixing efficiency. When the water content of the toner is more than 0.5% by mass, water in the toner vaporizes into steam when heated instantaneously to high temperature, which often leads to solubilization of other impurities generated during fixing, generation of deposits of the impurities, and also deformation of the fixed image by volume expansion during vaporization of the water in the toner into steam. The water content of the toner is more preferably 0.3% by mass or less and still more preferably 0.1% by mass or less.

Hereinafter, the method of producing the toner according to the invention will be described.

The toner according to the invention can be prepared by a method similar to known toner production methods such as pulverization method and polymerization method. In the pulverization method, the toner according to the invention is prepared, for example, as follows: First, components such as wax composition, colorant, and charge control agent are mixed as needed with the hematite, binder resin and infrared absorbent described above, and the mixture is then melt-extruded by a kneader, extruder, or the like. The melt blend obtained is then pulverized into coarse particles, further pulverized into fine powder, for example in a jet mill, and classified by an air classifier into toner particles having a desirable particle diameter. The toner according to the invention can be prepared further by adding an external additive to the toner particle as needed.

A suspension or emulsion polymerization method is mainly used in production by the polymerization method.

For preparation of the toner according to the invention by the suspension polymerization method, for example, the toner according to the invention is prepared as follows: First, a composition is prepared by dissolving or dispersing the hematite and infrared absorbent described above, a crosslinking agent such as divinylbenzene, and a polymerization initiator, and as needed a colorant, a charge control agent, a releasing agent, and the like in the monomers such as styrene, butyl acrylate, and 2-ethylhexyl acrylate.

A suspension of the composition is prepared then by adding the monomer composition in an aqueous phase containing a suspension stabilizer such as tricalcium phosphate or polyvinylalcohol and a surfactant and agitating the mixture, for example, in a rotor stator emulsifier, high-pressure emulsifier, ultrasonic emulsifier, or the like; the reaction container is deoxygenated, for example, by nitrogen substitution; and the mixture is then heated, to give particles in polymerization of the monomers.

After polymerization, the particles obtained are washed, dried, and added with an external additive as needed, to give the toner according to the invention.

Alternatively, the toner according to the invention is prepared in the emulsion polymerization, for example, by the method below. First, resin particles are prepared by adding monomers such as styrene, butyl acrylate, and 2-ethylhexyl acrylate in water containing a water-soluble polymerization initiator such as potassium persulfate dissolved therein and additionally a surfactant such as sodium dodecylsulfate as needed and allowing polymerization to progress by heating the mixture while stirring.

Then, the hetero-agglomerate is obtained by hetero-aggregating the resin particles, the hematite powder, and the like, by adding a pulverized powder preferably having a volume-average diameter of 1 μm or less of a mixture of the hematite and the infrared absorbent described above and additionally colorant, charge control agent, and releasing agent components, and the like as needed into the resin particle-dispersed suspension, and adjusting the pH, stirring strength, and temperature of the suspension. The reaction system is then heated to a temperature not lower than the glass transition temperature of the resin particles, to give toner particles by fusion of the hetero agglomerate. Then, the toner particles are washed, dried, and added with an external additive, to give the toner according to the invention.

The developer for developing an electrostatic latent image according to the invention includes the toner for developing an electrostatic latent image according to the invention and a carrier.

Any one of known carriers may be used as the carrier. An example thereof is a resin-coated carrier having a resin-coated layer on the core material surface. Alternatively, it may be a resin-dispersed carrier in which, for example, a conductive material is dispersed in the matrix resin.

Examples of the coating resins or matrix resins for use as the carrier include, but are not limited to, polyethylene, polypropylene, polystyrene, polyvinyl acetate, polyvinylalcohol, polyvinylbutyral, polyvinyl chloride, polyvinylether, polyvinylketone, polyvinyl chloride-vinyl acetate copolymers, styrene-acrylate copolymers, straight silicone resins having organosiloxane bonds or the modified resins thereof, fluoro-resins, polyester, polycarbonate, phenol resins, epoxy resins, and the like.

The coating or matrix resins for use as the carrier are preferably a thermosetting resin, and more preferably a resin having siloxane bonds (silicone resins).

Typical examples of the silicone resins include straight silicone resins such as methyl silicone resin, phenyl silicone resin, and methylphenyl silicone resin having a methyl group, a phenyl group, or both of them on the side chain; modified silicone resins thereof to which another organic resin is chemically bound; and the like.

Typical examples of the modified silicone resins include fluorine-containing resins, acrylic resins, epoxy resins, polyester resins, fluorine acrylic resins, acrylic styrene resins, alkyd resins, silicone resins modified, for example with a urethane resin, and a cross-linkable fluorine-modified silicone resins, and the like. Preferable are straight silicone resins and fluorine-modified silicone resins; and more preferable are fluorine-modified silicone resins.

Examples of the conductive materials include, but are not limited to, metal such as gold, silver, and copper; carbon black, titanium oxide, zinc oxide, barium sulfate, aluminum borate, potassium titanate, tin oxide, and the like.

Examples of the core materials for the carrier include magnetic metals such as iron, nickel, and cobalt; magnetic oxides such as ferrite and magnetite, glass bead, and the like; but the core material is preferably a magnetic material for use of the carrier in the magnetic brush method. The volume-average diameter of the carrier core material is generally 10 to 500 μm and preferably 30 to 100 μm.

A method of coating a coating solution containing the coating resin and as needed various additives dissolved in a suitable solvent is used for resin-coating the surface of the carrier core material. The solvent is not particularly limited, and selected properly, taking into consideration the coated resin used and coating compatibility.

Typical resin-coating methods include an immersion method of immersing the carrier core material in a coating solution, a spraying method of spraying a coating solution on the surface of the carrier core material, a fluidized-bed method of spraying a coating solution while floating the carrier core material in fluidizing air, and a kneader coater method of mixing the carrier core material and a coating layer-forming solution and removing the solvent in a kneader coater.

The blending ratio (weight ratio) of the photofixing color toner according to the invention to the carrier above, toner: carrier, in the two-component developer is in the range of approximately 1:100 to 30:100 and more preferably in the range of approximately 3:100 to 20:100.

The image-forming process by using the toner according to the invention is not particularly limited, if it allows formation of a toner image on an image-receiving member, and specifically, is preferably an image-forming process in the following electrophotographic mode:

The process include a charging step of charging a photoreceptor, an exposure step of forming a latent image on the photoreceptor by exposing the charged photoreceptor to light, a developing step of forming a toner image by developing the latent image formed on the photoreceptor with a developer containing a toner, a transferring step of transferring the toner image formed on the photoreceptor onto an image-receiving member, and a fixing step of fixing the toner image transferred on the image-receiving member, and the toner is the toner for developing an electrostatic latent image according to the invention described above.

Each of the steps above may be performed by any one of known methods used in conventional image-forming processes. The image-receiving member itself is a recording medium, if no intermediate transfer body or the like is used. In addition, the image-forming process may include additionally a step other than the steps above, for example, a cleaning step of cleaning the surface of the latent image-holding member.

When an electrophotographic photoreceptor is used as the electrostatic latent image-holding member, an image is formed in the image-forming process, for example, as follows: First, the surface of an electrophotographic photoreceptor is charged uniformly, for example by a corotron charger or a contact charger, and exposed to light, giving an electrostatic charged image. Then, a toner image is formed on the electrophotographic photoreceptor, by bringing the surface into contact with a developing roll having a developer layer formed and thus depositing toner particles on the electrostatic charged image. The toner image formed is transferred onto the surface of an image-receiving member such as paper by using, for example, a corotron charger. The toner image transferred on a recording medium surface is then fixed in a fixing unit, to give an image on the recording medium.

An inorganic photoreceptor such as amorphous silicon or selenium or an organic photoreceptor such as polysilane or phthalocyanine is generally used as the charge-generating material or the charge-transporting material of the electrophotographic photoreceptor, and in particular, an amorphous silicon photoreceptor is preferable because it has a longer life.

The fixing unit is not limited, and may be a photofixing unit, oven-fixing unit, heat-roll fixing unit, or the like.

Examples of the light sources for use in the fixing step include common halogen lamps, mercury lamps, flash lamps, infrared lasers, and the like, but flash lamps, which allow instantaneous fixing and thus conservation of energy, are most preferable. The emission energy of the flash lamp is preferably in the range of 1.0 to 7.0 J/cm$^2$ and more preferably in the range of 2 to 5 J/cm$^2$.

The emission energy of a flash light per unit area, an indicator of the intensity of a xenon lamp, is represented by the following Formula (2):

$$S=((1/2)\times C\times V^2)/(u\times L)\times(n\times f) \quad (2)$$

In the Formula (2), n represents the number of the lamps operating at the same time; f, a lighting frequency (Hz); V, an input voltage (V); C, a condenser capacity (F); u, a process traveling speed (cm/s); L, the effective lighting width of the flash lamp [usually, the maximum paper width (cm)]; and S, an energy density (J/cm$^2$).

The photofixing process according to the invention is preferably a delayed process wherein multiple flash lamps are lighted at a certain time interval. The delayed process is a process of placing multiple flash lamps in a row, lighting the respective lamps at an interval of approximately 0.01 to 100 ms, and irradiating the same area of a toner image multiple times. In this manner, the process, which applies fractioned light energies not all at once but repeatedly several times onto the toner image, makes the fixing condition milder and provides both superior void resistance and fixing efficiency.

When a toner image is irradiated with flash lights multiple times, the emission energy of the flash lamps means the total amount of the emission energies per unit area of respective flash lights.

In the invention, the number of the flash lamps is preferably in the range of 1 to 20 and more preferably in the range of 2 to 10. Additionally, the time interval between the multiple flash-lamp lightings is preferably in the range of 0.1 to 20 msec and more preferably in the range of 1 to 3 msec.

Yet additionally, the emission energy of single flash-lamp lighting is preferably in the range of 0.1 to 1 J/cm$^2$ and more preferably in the range of 0.4 to 0.8 J/cm$^2$.

In the photofixation described above by using flash lamps, the toner surface is heated instantaneously to high temperature, resulting in sublimation of the sublimates and adhesion thereof to exhaust gas filter and other members, but the toner according to the invention does not cause sublimation of sublimates even when heated instantaneously to high temperature and thus prevents adhesion thereof to the exhaust gas filter and other members.

If the fixing step is a heat-roll fixing step of fixing the toner image transferred on the image-receiving member in the nip area between a heating roll and another heating roll in contact therewith, the toner surface is heated to high temperature, resulting in sublimation of the sublimates and adhesion thereof to the exhaust gas filter and other members, when processed at a fixing speed of 400 mm/sec or more; but, even in such a case, it is possible to prevent sublimation of the sublimates and adhesion thereof to the exhaust gas filter and other members by using the toner according to the invention, even when the toner is heated to high temperature.

Some embodiments of the invention are outlined below.

According to an aspect of the invention, a toner for developing an electrostatic latent image comprises a releasing agent containing a hydrocarbon, a binder resin, and a colorant, wherein, when an average carbon number of the hydrocarbon is designated as N, the hydrocarbon contains components having a carbon number in the range of (N−10) to (N+10) in an amount of 70% by mass or more in the entire hydrocarbon and has a weight-average molecular weight of 12,000 or more and 25,000 or less.

The ratio (weight-average molecular weight)/(number-average molecular weight) of the binder resin may be 2.0 to 5.0.

The binder resin may be a polyester resin.

The acid value of the binder resin may be 5 to 50 mgKOH/g.

The acid value of the hydrocarbon may be 1 mgKOH/g or less.

The hydrocarbon may be a wax of saturated hydrocarbon.

The toner may further contain an infrared absorbent.

The water content of the toner may be 0.5% by mass or less with respect to total amount of the toner.

According to another aspect of the invention, a developer for developing an electrostatic latent image comprises a toner and a carrier, wherein the toner is the toner for developing an electrostatic latent image described in the aspect above.

The carrier may be coated with a resin, which is a thermosetting resin.

The thermosetting resin may be a silicone resin.

According to another aspect of the invention, an image-forming process comprises charging a photoreceptor, forming a latent image on the photoreceptor by exposing the charged photoreceptor to light, forming a toner image by developing the latent image formed on the photoreceptor with a developer containing a toner, transferring the toner image formed on the photoreceptor onto an image-receiving member, and fixing the toner image transferred onto the image-receiving member, wherein the toner is the toner for developing an electrostatic latent image according to the invention described above.

The fixing step may be a step of fixing the toner image transferred on the image-receiving member by the heat generated by flash light irradiation.

The fixing step may be a step of irradiating light from the flash lamp multiple times at a certain time interval.

The emission energy of a flash lamp may be in the range of 0.1 to 1 J/cm$^2$.

EXAMPLES

Hereinafter, the present invention will be described in detail with reference to Examples, but it should be understood that the invention is not restricted thereby. In the following description, the "part" is a part by mass, unless specified otherwise.

(Method of Measuring Particle Diameter and Particle-Diameter Distribution)

The particle diameter in the invention (also referred to as "particle size") and the method of measuring the particle diameter distribution (also referred to as "particle size distribution measurement") will be described below.

In the invention, when the diameter of the particles to be analyzed is 2 μm or more, the analyzer used is Coulter Multisizer II (manufactured by Beckmann Coulter) and the electrolyte solution used is ISOTON-II (manufactured by Beckmann Coulter).

In measurement, 0.5 to 50 mg of an analyte sample is added to 2 ml of an aqueous solution containing a surfactant as a dispersant, preferably aqueous 5% sodium alkylbenzenesulfonate solution. The mixture is added to 100 ml of the electrolyte solution above.

The sample-suspended electrolyte solution is dispersed in an ultrasonic homogenizer for approximately 1 minute, and the volume- and number-average particle distributions are determined by analyzing particles of 2 to 60 μm in diameter, by using the Coulter Multisizer II and an aperture having a diameter of 100 μm. The number of particles measured is 50,000.

The particle-diameter distribution of the toner according to the invention is determined as follows: A cumulative distribution curve is drawn from the smallest diameter by plotting the volume-average number in each divided particle diameter range (channel) from the measured particle-diameter distribution, and the cumulative volumetric particle diameter at cumulative 16% is defined as D16p, the cumulative volumetric particle diameter at cumulative 50% as D50v, and the cumulative volumetric particle diameter at cumulative 84% as D84p.

The volume-average diameter is the D50v, and GSDp is calculated according to the following Formula:

$$GSDp=\{(D84p)/(D16p)\}^{0.5}$$

When the diameter of the particles measured is less than 2 μm, the apparatus used is, for example, a laser-diffraction particle-diameter distribution analyzer (LA-700: manufactured by Horiba, Ltd.). In measurement, a dispersion containing a sample in an amount of approximately 2 g as solid content is prepared and diluted with ion-exchange water to a total volume of approximately 40 ml. The dispersion is placed in a cell and left for approximately two minutes, and measured after the concentration in the cell is uniformized. The diameter obtained in each channel was cumulated from the smaller volume-average diameter, and the diameter at cumulative 50% is defined as the volume-average diameter.

In measurement of other powders such as external additive, 2 g of a sample is added to 50 ml of an aqueous solution of a surfactant, preferably 5% sodium alkylbenzenesulfonate; the mixture is dispersed in an ultrasonic dispersing machine (1,000 Hz) for 2 minutes; and the sample thus prepared is measured by a method similar to that described above.

(Methods of Determining the Molecular Weights and Molecular Weight Distributions of Toner, Resin, and Releasing Agent)

The particular molecular weight distribution of the toner for developing an electrostatic latent image according to the invention is determined under the following condition: GPC apparatus: "HLC-8120 GPC, SC-8020 (manufactured by Tosoh Corporation); column: two columns; "TSK gel, Super HM-H (manufactured by Tosoh Corporation, 6.0 mmID×15 cm)"; and eluant: toluene. The sample concentration in the test was 0.5% by mass; the flow rate, 0.6 ml/min; the sample injection, 10 μl, the measurement temperature, 60° C.; and the detector, an IR detector. The calibration curve is drawn by using ten polystyrene standard samples "TSK Standards" manufactured by Toso Corporation: "A-500", "F-1", "F-10", "F-80", "F-380", "A-2500", "F-4", "F-40", "F-128", and "F-700".

(Method of Measuring the Melting Point of Releasing Agent and the Glass Transition Temperature of Toner)

The melting point of the releasing agent used in the toner and the glass transition temperature of the toner according to the invention are determined from the main maximum peak obtained by using a DSC (differential scanning calorimeter) according to the method specified by ASTM D3418-8.

DSC-7 manufactured by Perkin Elmer is used for measurement of the main maximum peak. The apparatus is calibrated by using the melting points of indium and zinc for temperature correction and by using the fusion heat of indium for calorimetric correction of the detector. The measurement is performed by heating a sample on an aluminum pan together with an empty pan as the reference at a programmed heating rate of 10° C./min.

(Acid Value of Resin and Releasing Agent)

The acid values of the binder resin and the toner are determined according to the potentiometric titration method specified by JIS K0070-1992, the disclosure of which is incorporated by reference herein.

(Preparation of Releasing Agent 1)

Releasing agent components having a retention time corresponding to a molecular weight of 14,900 to 15,100 are fractioned from polyethylene (NL-900: manufactured by Mitsui Chemicals, Inc.) in a preparative HPLC apparatus described above (LC-9101, manufactured by Japan Analytical Industry Co. Ltd.). Toluene is evaporated from the fractioned solution, to give a releasing agent 1. Toluene is removed in an evaporator under the condition of 100 Pa and 60° C.

The hydrocarbon in the releasing agent 1 obtained has a Mw of 15,000, and an average carbon number N of 1,071; and the ratio of the components having a carbon number in the range of 1,061 to 1,081 is 91% by mass. Results are summarized in Table 1.

(Preparation of Releasing Agent 2)

A releasing agent 2 is prepared in a similar manner to releasing agent 1, except that releasing agent components having a retention time corresponding to a molecular weight of 14,900 to 15,300 are fractioned by preparative HPLC. The hydrocarbon in the releasing agent 2 obtained has a Mw of 15,100, and an average carbon number N of 1,079; and the ratio of the components having a carbon number in the range of 1,069 to 1,089 is 82% by mass. Results are summarized in Table 1.

(Preparation of Releasing Agent 3)

A releasing agent 3 is prepared in a similar manner to releasing agent 1, except that releasing agent components having a retention time corresponding to a molecular weight of 14,800 to 15,500 are fractioned by preparative HPLC. The hydrocarbon in the releasing agent 3 obtained has a Mw of 15,200, and an average carbon number N of 1,086; and the ratio of the components having a carbon number in the range of 1,076 to 1,096 is 72% by mass. Results are summarized in Table 1.

(Preparation of Releasing Agent 4)

Releasing agent components having a retention time corresponding to a molecular weight of 11,800 to 12,200 are fractioned from polyethylene (mixture of 100 parts of NL-900 and 100 parts of NL-800 (manufactured by Mitsui Chemicals, Inc.)) in a preparative HPLC apparatus described above (LC-9101, manufactured by Japan Analytical Industry Co. Ltd.). The hydrocarbon in the releasing agent 4 obtained has a Mw of 12,100 and an average carbon number N of 864; and the ratio of the components having a carbon number in the range of 854 to 874 is 88% by mass. Results are summarized in Table 1.

(Preparation of Releasing Agent 5)

Releasing agent components having a retention time corresponding to a molecular weight of 24,000 to 25,000 are fractioned from polyethylene (Creolex K4125: manufactured by Asahi Kasei Chemicals Corp.) in a preparative HPLC apparatus described above (LC-9101, manufactured by Japan Analytical Industry Co. Ltd.).

The hydrocarbon in the releasing agent 5 obtained has a Mw of 24,600 and an average carbon number N of 1,757; and the ratio of the components having a carbon number in the range of 1,747 to 1,767 is 71% by mass. Results are summarized in Table 1.

(Preparation of Releasing Agent 6)

A releasing agent 6 is prepared in a similar manner to releasing agent 1, except that releasing agent components having a retention time corresponding to a molecular weight of 14,000 to 15,500 are fractioned by preparative HPLC. The hydrocarbon in the releasing agent 6 obtained has a Mw of 14,800 and an average carbon number N of 1,057; and the ratio of the components having a carbon number in the range of 1,047 to 1,067 is 65% by mass. Results are summarized in Table 1.

(Preparation of Releasing Agent 7)

Releasing agent components having a retention time corresponding to a molecular weight of 11,000 to 11,700 are fractioned from polyethylene (800P: manufactured by Mitsui Chemicals, Inc.) in a preparative HPLC apparatus described above (LC-9101, manufactured by Japan Analytical Industry Co. Ltd.).

The hydrocarbon in the releasing agent 7 obtained has a Mw of 11,400 and an average carbon number N of 814; and the ratio of the components having a carbon number in the range of 804 to 824 is 84% by mass. Results are summarized in Table 1.

(Preparation of Polyester Resin 1)

35 mole parts of polyoxyethylene (2,0)-2,2-bis(4-hydroxyphenyl)propane, 65 mole parts of polyoxypropylene (2,2)-2,2-bis(4-hydroxyphenyl)propane, 95 mole parts of terephthalic acid, 5 mole parts of trimellitic acid, 0.05 mole part, with respect to these acid components (total mole number of terephthalic acid and trimellitic acid), of dibutyltin oxide are placed in a two-necked flask previously heated and dried; after a nitrogen gas is supplied into the container, the mixture is heated under an inert environment and allowed to polycondense at 180 to 200° C. for 12 hours and additionally at 210 to 250° C. under a reduced pressure gradually declining to 100 Pa, to give a polyester resin 1. The weight-average molecular weight (Mw) of the polyester resin 1 obtained (converted with polystyrene), as determined by GPC (gel-permeation chromatography), is 16,000; the number-average molecular weight (Mn), 6,900; and the ratio (weight-average molecular weight)/(number-average molecular weight), 2.31. The acid value of the polyester resin 1 is 12 mgKOH/g.

(Preparation of Polyester Resin 2)

A polyester resin 2 is prepared in a similar manner to polyester resin 1, except that the amounts of terephthalic acid and trimellitic acid in preparation of the polyester resin 1 are changed respectively to 92 mole parts and 8 mole parts and the amount of dibutyltin oxide to 0.08 mole parts.

The polyester resin 2 obtained has a weight-average molecular weight (Mw) of 21,000, a number-average molecular weight (Mn) of 6,100, and a ratio (weight-average molecular weight)/(number-average molecular weight) of 3.44. The acid value of the polyester resin 2 is 15 mgKOH/g.

(Preparation of Polyester Resin 3)

A polyester resin 3 is prepared in a similar manner to polyester resin 1, except that the amounts of terephthalic acid and trimellitic acid in preparation of the polyester resin 1 are changed respectively to 90 mole parts and 10 mole parts and the amount of dibutyltin oxide to 0.1 mole parts.

The polyester resin 3 obtained has a weight-average molecular weight (Mw) of 23,000, a number-average molecular weight (Mn) of 5,100, and a ratio (weight-average molecular weight)/(number-average molecular weight) of 4.71. The acid value of the polyester resin 3 is 26 mgKOH/g.

(Preparation of Polyester Resin 4)

A polyester resin 4 is prepared in a similar manner to polyester resin 1, except that the amounts of terephthalic acid and trimellitic acid used in preparation of the polyester resin 1 are changed respectively to 87 mole parts and 13 mole parts and the amount of dibutyltin oxide to 0.09 mole parts.

The polyester resin 4 obtained has a weight-average molecular weight (Mw) of 22,000, a number-average molecular weight (Mn) of 4,200, and a ratio (weight-average molecular weight)/(number-average molecular weight) of 5.24. The acid value of the polyester resin 4 is 35 mgKOH/g.

(Preparation of Toner 1)

88 parts of a polyester resin 1, 5 parts of carbon (NIPEX-3: Degussa), and 7 parts of a releasing agent 1 are placed and mixed in a Henschel Mixer, and the mixture is further blended in an extruder at 180° C. The mixture is then pulverized with a hammer mill and then with a jet mill into fine powder and classified in an air classifier, to give a black-colored particles having a volume-average diameter of 8.7 μm. Then, 0.8 parts of hydrophobic silica particles (TG820F: CABOT) are added thereto and blended in a Henschel Mixer, to give a black powdery toner 1.

(Preparation of Toners 2 to 7)

Toners 2 to 7 are prepared in a similar manner to toner 1, except that the releasing agent 1 used in preparation of toner 1 is replaced respectively with a releasing agent 2 to 7.

(Preparation of Toners 8 to 10)

Toners 8 to 10 are prepared in a similar manner to toner 1, except that the polyester resin 1 used in preparation of toner 1 is replaced respectively with a polyester resin 2 to 4.

The water content of each toner 1 to 10 thus obtained is determined by the following method: The results are summarized in Table 1. The water content is determined as follows: The water content is determined according to the volumetric titration method specified by JIS K-0068-2001, the disclosure of which is incorporated by reference herein, by using a Karl Fischer analyzer manufactured by Kyoto Electronics Manufacturing Co., Ltd. The sample amount is 2 g; oven temperature, 200° C.; heating time, 10 minute; and the measurement is performed under nitrogen gas at a flow rated of 200 ml/minute. A Karl Fischer solution manufactured by Mitsubishi Chemical Corp. is used as it is.

(Preparation of Developer 1)

To a carrier having a volume-average diameter of 50 μm prepared by coating 2 parts of a silicone resin (SR2410: manufactured by Dow Corning Toray Silicone, previously sintered at 150° C. for 30 minutes) on the surface of 98 parts of a carrier core material of manganese ferrite particles, added is 4.5 parts of the toner 1; and the mixture is blended in a 20-L ball mill for 30 minutes, to give a developer 1.

(Preparation of Developers 2 to 10)

Developers 2 to 10 are prepared in a similar manner to developer 1, except that the toner 1 used in preparation of the developer 1 is replaced respectively with the toner 2 to 10.

Example 1

A toner powder image is formed on a heat-resistant polyimide film to a deposition amount of 0.7 mg/cm$^2$ by using the developer 1 in a partially modified high-speed printer F6760D (manufactured by Fujitsu). The toner powder image is formed in the charging, exposure, development, and transferring steps but not in the fixing step in the modified high-speed printer F6760D.

(Evaluation of the Life of Exhaust Gas Filter by Actual Operation of Machine)

The lifetime of an exhaust gas filter in the modified high-speed printer F6760D (Fujitsu) is determined by measuring the pressure drop of its exhaust gas filter while images are printed continuously by using the developer 1 at a printing rate of 60%, by using a pressure-drop meter (DPG 203N15: Okano Works). The results are summarized in Table 1. The number of papers printed when there is drastic increase in pressure drop is shown in Table 1. When there is no problem even after printing on 300,000 papers, it was expressed by "no problem".

Separately, the degree of clogging of the exhaust gas filter then is also evaluated. The results are summarized in Table 1. The evaluation criteria are as follows: no clogging, G1; slight clogging but practically no problem, G2; some clogging but allowable, G3; and clogging G4.

Examples 2 to 8 and Comparative Examples 1 and 2

The lifetime of an exhaust gas filter in the modified high-speed printer F6760D (Fujitsu) and the degree of clogging are evaluated in a similar manner to Example 1, except that the developer 1 used in Example 1 is replaced with the developer 2 to 10 shown in Table 1. The results are summarized in Table 1.

TABLE 1

| | | Toner | | Releasing agent | | | | | Evaluation results | |
|---|---|---|---|---|---|---|---|---|---|---|
| | Developer Kind | Kind | Water content (% by mass) | Kind | Weight-average molecular weight | Average carbon number N | Ratio of the component in the range of N − 1 to N + 10 | Binder resin Kind | Number of papers when the pressure drop of exhaust gas filter rises | Clogging |
| Example 1 | Developer 1 | Toner 1 | 0.1 | Releasing agent 1 | 15000 | 1071 | 91% by mass | Polyester resin 1 | No problem | G1 |
| Example 2 | Developer 2 | Toner 2 | 0.3 | Releasing agent 2 | 15100 | 1079 | 82% by mass | Polyester resin 1 | No problem | G2 |
| Example 3 | Developer 3 | Toner 3 | 0.5 | Releasing agent 3 | 15200 | 1086 | 72% by mass | Polyester resin 1 | No problem | G3 |
| Example 4 | Developer 4 | Toner 4 | 0.2 | Releasing agent 4 | 12100 | 864 | 88% by mass | Polyester resin 1 | No problem | G2 |
| Example 5 | Developer 5 | Toner 5 | 0.4 | Releasing agent 5 | 24600 | 1757 | 71% by mass | Polyester resin 1 | No problem | G3 |
| Example 6 | Developer 8 | Toner 8 | 0.1 | Releasing agent 1 | 15000 | 1071 | 91% by mass | Polyester resin 2 | No problem | G1 |
| Example 7 | Developer 9 | Toner 9 | 0.3 | Releasing agent 1 | 15000 | 1071 | 91% by mass | Polyester resin 3 | No problem | G2 |
| Example 8 | Developer 10 | Toner 10 | 0.5 | Releasing agent 1 | 15000 | 1071 | 91% by mass | Polyester resin 4 | No problem | G3 |

TABLE 1-continued

| | | | | | | | | | Evaluation results | |
|---|---|---|---|---|---|---|---|---|---|---|
| | | Toner | | Releasing agent | | | | | | |
| | Developer Kind | Kind | Water content (% by mass) | Kind | Weight-average molecular weight | Average carbon number N | Ratio of the component in the range of N − 1 to N + 10 | Binder resin Kind | Number of papers when the pressure drop of exhaust gas filter rises | Clogging |
| Comparative Example 1 | Developer 6 | Toner 6 | 0.7 | Releasing agent 6 | 14800 | 1057 | 65% by mass | Polyester resin 1 | 150,000 | G4 |
| Comparative Example2 | Developer 7 | Toner 7 | 1.0 | Releasing agent 7 | 11400 | 814 | 84% by mass | Polyester resin 1 | 100,000 | G4 |

In regard to the pressure drop of the exhaust gas filter during continuous printing, the developer prepared by using the toner 1 to 5 or 8 to 10 results in no increase in pressure drop and allows stabilized operation even after printing on 300,000 sheets, but the developer prepared by using the toner 6 or 7 results in significant increase in pressure drop at the sheet number of 100,000 to 150,000. Observation of the cross section of the exhaust gas filter when the toner 1 is used reveals that the exhaust gas filter collects dusts penetrating uniformly into the lower layer of the filter. In contrast, the exhaust gas filter using the toner 2 to 5 shows clogging in the upper layer of the filter to a degree without problem, while that using the toner 6 or 7 shows clogging in the upper layer of the filter.

As apparent from the results, by using the toner according to the invention, it is possible to reduce the sublimation of tone components during fixing caused by irradiation of flash light or during high-speed fixing and the increase in pressure drop caused by solidification of the sublimates cooled in the upper layer of the exhaust gas filter, and thus, to elongate the filter lifetime because of efficient use of the entire filter surface.

In contrast, when toners prepared in Comparative Examples are used, it is difficult to avoid the clogging of exhaust gas filter and the increase in pressure drop due to sublimation of the wax components, i.e., a releasing agent and a fixing aid in the toner, and to obtain stabilized dust-collecting operation of the effluent gas filter.

According to the aspect of the invention, it is possible to provide a toner for developing an electrostatic latent image and a developer for developing an electrostatic latent image that do not cause sublimation of low-polar sublimates even when the toner surface is heated to high temperature during fixing or deposition on the exhaust gas filter and other members, and an image-forming process using the same.

All publications, patent applications, and technical standards mentioned in this application are herein incorporated by reference to the same extent as if each individual publication, patent application, or technical standard was specifically and individually indicated to be incorporated by reference.

What is claimed is:

1. A toner for developing an electrostatic latent image comprising a releasing agent containing a hydrocarbon, a binder resin, and a colorant, wherein, when an average carbon number of the hydrocarbon is designated as N, the average carbon number N of the hydrocarbon is from 850 to 1,790, the hydrocarbon contains components having a carbon number in the range of (N−10) to (N+10) in an amount of 70% by mass or more in the entire hydrocarbon and has a weight-average molecular weight of from approximately 12,000 to approximately 25,000, and the toner is a photo fixing toner that is fixed at a temperature of 300° C. or higher through delayed photofixing wherein multiple flash lamps are lighted at certain time intervals.

2. The toner for developing an electrostatic latent image of claim 1, wherein a ratio (weight-average molecular weight)/(number-average molecular weight) of the binder resin is approximately 2.0 to approximately 5.0.

3. The toner for developing an electrostatic latent image of claim 1, wherein the binder resin is a polyester resin.

4. The toner for developing an electrostatic latent image of claim 1, wherein an acid value of the binder resin is approximately 5 to approximately 50 mgKOH/g.

5. The toner for developing an electrostatic latent image of claim 1, wherein the acid value of the hydrocarbon is approximately 1 mgKOH/g or less.

6. The toner for developing an electrostatic latent image of claim 1, wherein the hydrocarbon is a wax of saturated hydrocarbon.

7. The toner for developing an electrostatic latent image of claim 1, wherein the toner further contains an infrared absorbent.

8. The toner for developing an electrostatic latent image of claim 1, wherein a water content of the toner is approximately 0.5% by mass or less with respect to the total amount of the toner.

9. A developer for developing an electrostatic latent image comprising a toner and a carrier, wherein the toner is the toner for developing an electrostatic latent image according to claim 1.

10. The developer for developing an electrostatic latent image of claim 9, wherein the carrier is coated with a resin and the resin is a thermosetting resin.

11. The developer for developing an electrostatic latent image of claim 10, wherein the thermosetting resin is a silicone resin.

12. An image-forming process comprising:

charging a photoreceptor;

forming a latent image on the photoreceptor by exposing the charged photoreceptor to light;

forming a toner image by developing the latent image formed on the photoreceptor with a developer containing a toner;

transferring the toner image formed on the photoreceptor onto an image-receiving member; and fixing the toner image transferred onto the image-receiving member, wherein the toner is the toner for developing an electrostatic latent image according to claim 1.

13. The image-forming process of claim 12, wherein the fixing is fixing the toner image transferred onto the image-receiving member by heat generated by flash light irradiation.

14. The image-forming process of claim 12, wherein the fixing is irradiating light from a flash lamp multiple times at a certain time interval.

15. The image-forming process of claim 14, wherein the emission energy of the flash lamp is in the range of approximately 0.1 to approximately 1 $J/cm^2$.

* * * * *